US009656312B2

(12) United States Patent
Schunn et al.

(10) Patent No.: US 9,656,312 B2
(45) Date of Patent: May 23, 2017

(54) 4-ROLL, 6-ROLL, 18-HS-ROLL STAND HAVING A CASSETTE-TYPE DESIGN

(75) Inventors: Konrad Schunn, Korschenbroich (DE); Lothar Zwingmann, Haan (DE); Holger Pulst, Mettmann (DE); Arnulf Wurm, Olpe (DE); Ruediger Holz, Neunkirchen (DE)

(73) Assignee: SMS GROUP GMBH, Duesseldorf (DE)

( * ) Notice: Subject to any disclaimer, the term of this patent is extended or adjusted under 35 U.S.C. 154(b) by 1417 days.

(21) Appl. No.: 13/378,942

(22) PCT Filed: Jul. 7, 2010

(86) PCT No.: PCT/EP2010/004086

§ 371 (c)(1),
(2), (4) Date: Mar. 20, 2013

(87) PCT Pub. No.: WO2011/003580

PCT Pub. Date: Jan. 13, 2011

(65) Prior Publication Data

US 2013/0192327 A1 Aug. 1, 2013

(30) Foreign Application Priority Data

Jul. 7, 2009 (DE) ..... 10 2009 032 200
Dec. 28, 2009 (DE) ..... 10 2009 060 642

(51) Int. Cl.
*B21B 31/02* (2006.01)
*B21B 13/14* (2006.01)
(Continued)

(52) U.S. Cl.
CPC ..... *B21B 13/14* (2013.01); *B21B 13/145* (2013.01); *B21B 13/147* (2013.01); *B21B 29/00* (2013.01); *B21B 31/02* (2013.01); *B21B 31/10* (2013.01); *B21B 31/103* (2013.01); *B21B 13/142* (2013.01); *B21B 2013/025* (2013.01); *B21B 2013/028* (2013.01); *B21B 2203/06* (2013.01);
(Continued)

(58) Field of Classification Search
CPC ..... B21B 29/00; B21B 31/20; B21B 31/203; B21B 37/38; B21B 31/02; B21B 31/04; B21B 31/32
USPC ..... 72/237, 245
See application file for complete search history.

(56) References Cited

U.S. PATENT DOCUMENTS 4,615,202 A 10/1986 Stoy et al.
4,898,014 A 2/1990 Ginzburg
(Continued)

FOREIGN PATENT DOCUMENTS

EP 0698428 A 2/1996
JP S61129208 A 6/1986
(Continued)

*Primary Examiner* — Debra Sullivan
(74) *Attorney, Agent, or Firm* — Andrew Wilford

(57) ABSTRACT

The invention concerns a 4-high/6-high/18 HS cassette-type roll stand in which bending force is transmitted to bending journals (6) of roll inserts (7) by piston-cylinder units that are connected with Mae West blocks (3).

Here, the piston at the piston rod (1) is fixedly connected with the Mae West block (3) and the cylinders (4) fit around the bending journals (6) at the inserts (7) of the rolls, so that thereby bending force can be transmitted directly to the bending journals (6) of the roll inserts (7).

2 Claims, 3 Drawing Sheets

(51) Int. Cl.

| | |
|---|---|
| ***B21B 29/00*** | (2006.01) |
| ***B21B 31/10*** | (2006.01) |
| *B21B 13/02* | (2006.01) |

(52) U.S. Cl.
CPC ..... *B21B 2269/04* (2013.01); *B21B 2269/06* (2013.01); *B21B 2269/14* (2013.01)

(56) References Cited

U.S. PATENT DOCUMENTS

| | | | | |
|---|---|---|---|---|
| 4,967,582 | A | 11/1990 | Bohnenkamp | |
| 2006/0021412 | A1* | 2/2006 | Denker | 72/241.8 |

FOREIGN PATENT DOCUMENTS

| | | | |
|---|---|---|---|
| JP | 4022503 | B2 | 12/2007 |
| WO | 2004052568 | A | 6/2004 |

* cited by examiner

4-ROLL, 6-ROLL, 18-HS-ROLL STAND HAVING A CASSETTE-TYPE DESIGN

CROSS REFERENCE TO RELATED APPLICATIONS

This application is the US-national stage of PCT application PCT/EP2010/004086 filed 7 Jul. 2010, published 13 Jan. 2011 as WO2011/003580, and claiming the priority of German patent application 102009032200.0 itself filed 7 Jul. 2009 and German patent application 102009060642.4 itself filed 28 Dec. 2009, whose entire disclosures are herewith incorporated by reference.

FIELD OF THE INVENTION

The invention relates to a cassette-type 4-high/6-high/18 HS roll stand.

BACKGROUND OF THE INVENTION

With known cassette-type 4/6-high 18 HS roll stands it is not possible to combine of the various operating modes such as CVC Plus® four-high and/or 6-high, as well as also CVC Plus® 18 HS.

An essential demand made of a combined roll stand is the possibility of switching between the two operating modes during a standard roll change without having to do any retrofitting steps on the stand.

OBJECT OF THE INVENTION

It is therefore the object of the invention to be able to roll using different operating modes and roll diameters in a roll stand by minimizing the time periods required for retrofitting and thus correspondingly increase annual output.

SUMMARY OF THE INVENTION

This object is attained in accordance with the invention by a 4-roll/6-roll/18 HS cassette-type roll stand in which the bending force is transmitted by piston-cylinder units connected with Mae West blocks to the bending pins of the roll chocks such that the piston is connected fixedly with the Mae West block at the piston rod and that the cylinders fit around the bending pins at the chocks of the rolls, so that this way the bending force can be directly transmitted to the bending pins of the roll chocks.

Preferably, the piston rod of the bending cylinder of the upper roll and the piston rod of the lower roll are made of one piece.

According to a further embodiment the hydraulic supply for the front piston sides as well as for the back ring sides takes place by means of the piston rod.

The combined roll stand, as well as the reducing stand, and also the skin pass mill is to be used for mild steel, high strength steel, stainless steel and NE metals.

The work-roll sets of a 4-high or 6-high cassette-type roll stand can be changed with intermediate roll sets (including end support rolls) and the work rolls of the 18 HS stand.

The change position of the work-roll sets in the 4-high or 6-high stand is identical with the change position of the intermediate-roll sets in the 18 HS stand.

For both operating modes, the same axial displacement cylinders and bending cylinders are used. Large strokes are required for the bending cylinders in limited space at minimum roll diameters in the 4/6-high roll stand in order to cover both operating modes and the corresponding roll diameter configurations, as well as the common roll tool change position.

In known designs for bending cylinders, the cylinders are fixedly mounted in Mae West blocks and the bending force is transmitted to the bending pins of the roll chocks by the piston rods and an intermediate guide piece.

The bending concept in accordance with the invention is that the piston at the piston rod is fixedly connected with the Mae West block, i.e. that the cylinder is displaced.

The movable cylinders are pushed upward or downward. The cylinders are designed in such a way that they fit around the bending pins at the chocks of the rolls and that as a result, the bending force is transferred directly to the bending pins of the roll chocks.

The piston rod of the bending cylinder of the upper roll and the piston rod of the bending cylinder of the lower rolls are made of one piece.

The hydraulic supply for the piston sides as well as for the ring sides takes place is through the piston rod.

This bending concept permits large strokes in a compact design, ideal for use in combination roll stands. This way, the work rolls in the four-roll or six-roll roll stand, as well as also the intermediate rolls in the 18 HS roll stand, can be raised or lowered to the height required for changing the rolls, and then be changed as a complete set with the same carriage. Due to the cassette construction of the roll sets, the time required for switching between operating modes is reduced to the time required for a normal roll change.

Only as a result of this bending concept is it possible to have a cassette-type roll stand for both operating modes, for CVC Plus® 4-high or 6-high, as well as CVC Plus® 18 HS.

BRIEF DESCRIPTION OF THE DRAWING

In the following, the invention will be explained in more detail with reference to the drawings. Therein.

SPECIFIC DESCRIPTION OF THE INVENTION

Figure 1A:
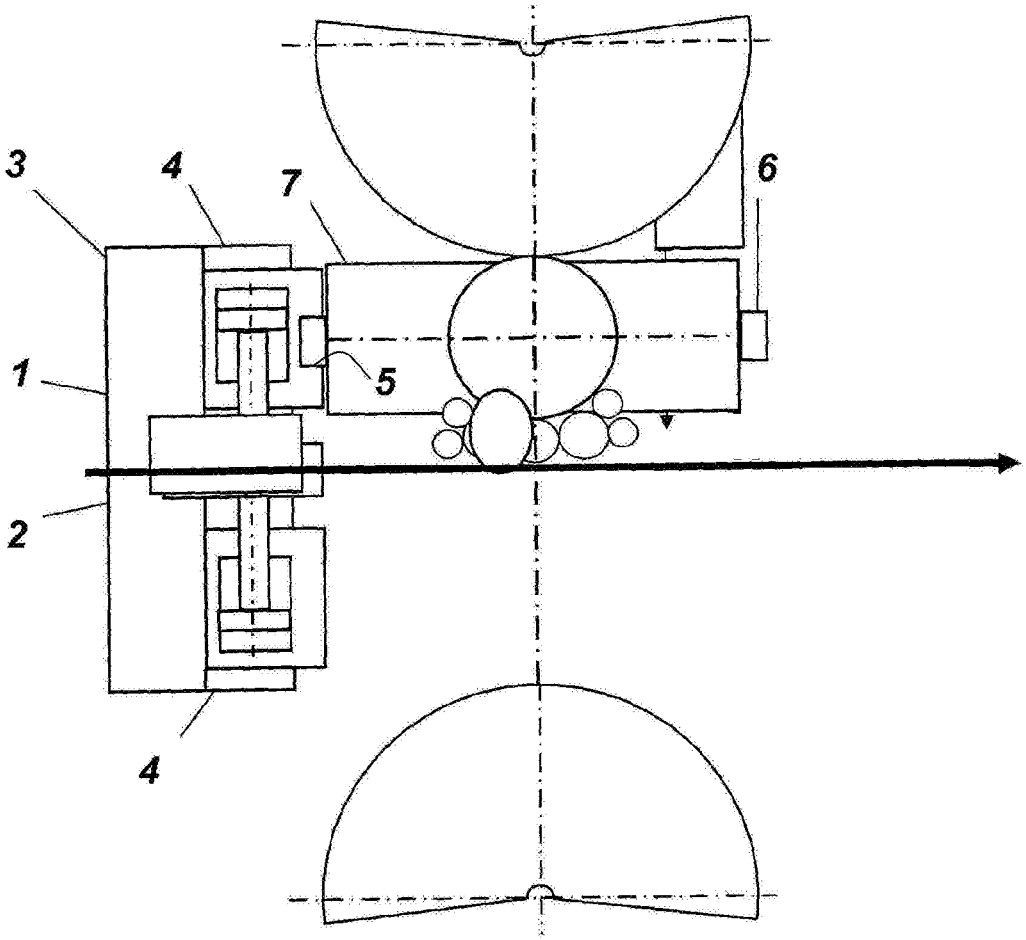
FIG. 1*a* is a schematic view of a roll stand in 18 HS setup.
Figure 1B:
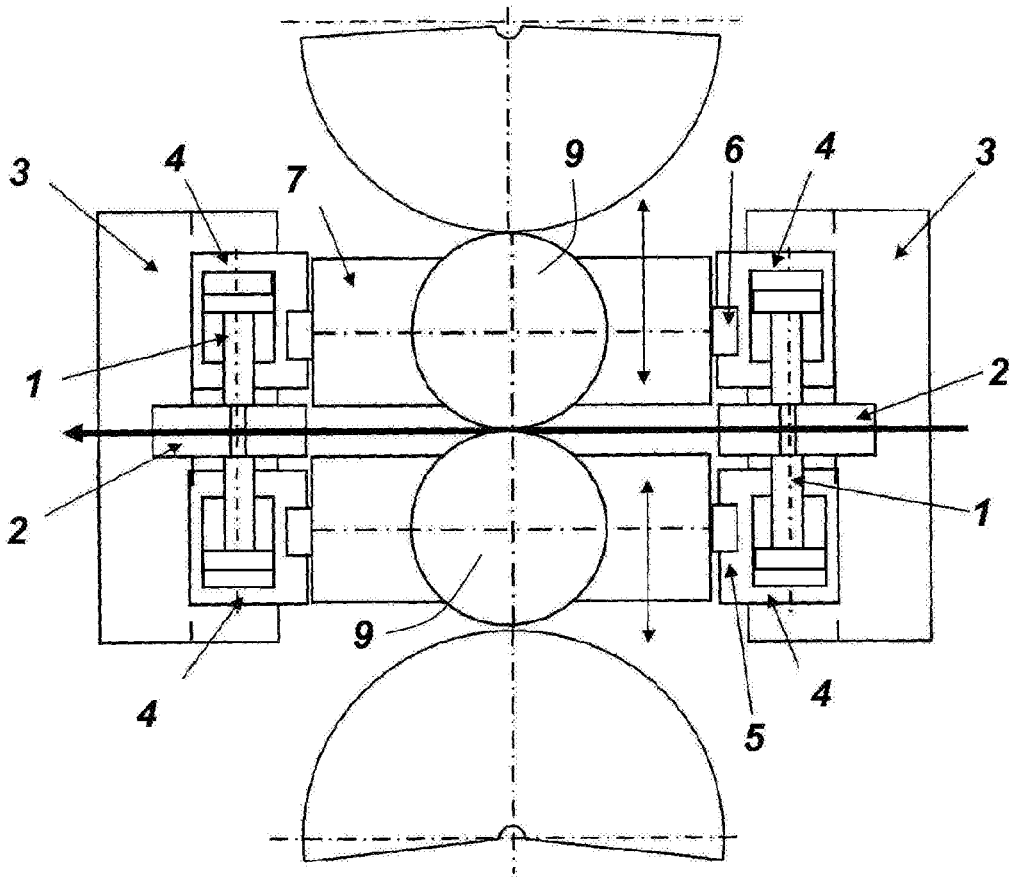
FIG. 1*b* is a schematic view of a roll stand in 4-high setup.
Figure 1C:
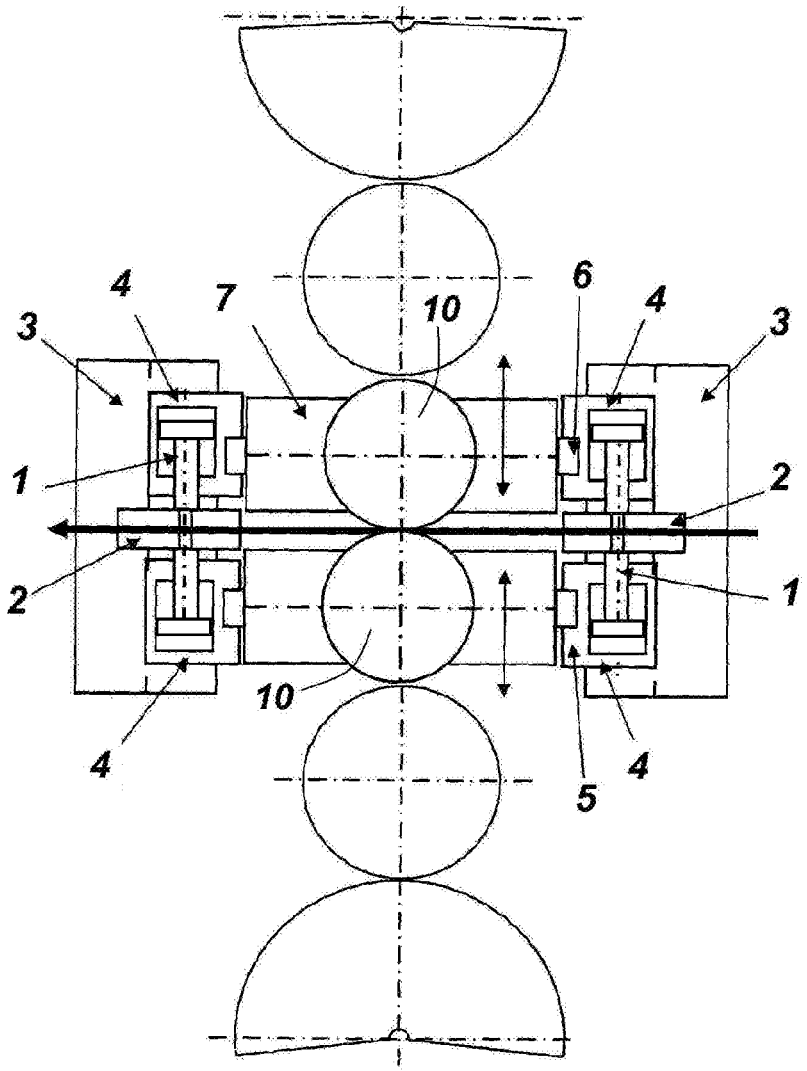
FIG. 1*c* is a schematic view of a roll stand in 6-high setup.

Piston rods 1 are solidly retained by holder blocks 2 in respective Mae West blocks 3. Their cylinders 4 move vertically in guides in the respective Mae West blocks 3 as the result of the application of pressure to the piston side or ring side, and transmit by means of the seats 5 in the cylinders 4 bending forces to pins 6 of the roll chocks 7 to these, and correspondingly to the roll pins of the intermediate roll in the 18 HS roll stand (FIG. 1*a*) or the work roll 9 in the 4-high roll stand (FIG. 1*b*) or 10 in the 6-high roll stand (FIG. 1*c*).

The invention claimed is:

1. A cassette-type 4-high/6-high/18 HS roll stand comprising:

a roll set comprised of upper and lower work rolls;

respective upper and lower chocks carrying the upper and lower work rolls and each having a bending pin;

stationary Mae West blocks adjacent the chocks;

respective double-acting upper and lower bending cylinders vertically shiftable in the blocks and each having a piston compartment and an opposite ring compartment, each of the bending pins being journaled in a respective one of the cylinders; and respective pistons in the cylinders having piston rods fixed to the respective blocks and formed unitarily and integrally of one piece so as to move jointly.

2. The 4-high/6-high/18 HS roll stand according to claim 1, wherein a hydraulic supply is connected to the piston compartment of each cylinder as well as to the ring compartment of each cylinder through the respective piston rod.

* * * * *